US005991585A

United States Patent [19]

Nakamura

[11] Patent Number: 5,991,585

[45] Date of Patent: Nov. 23, 1999

[54] DEVELOPING DEVICE FOR AN IMAGE FORMING APPARATUS AND DEVELOPING ROLLER THEREFOR

[75] Inventor: Makoto Nakamura, Kanagawa, Japan

[73] Assignee: Ricoh Company, Ltd., Tokyo, Japan

[21] Appl. No.: 09/160,595

[22] Filed: Sep. 25, 1998

[30] Foreign Application Priority Data

Sep. 26, 1997 [JP] Japan ..... 9-279713
Aug. 31, 1998 [JP] Japan ..... 10-260943

[51] Int. Cl.[6] ..... G03G 15/09

[52] U.S. Cl. ..... 399/267; 399/273; 399/277

[58] Field of Search ..... 399/267, 273, 399/277

[56] References Cited

U.S. PATENT DOCUMENTS 5,655,191 8/1997 Furuya et al. ..... 399/277

FOREIGN PATENT DOCUMENTS 64-2081 1/1989 Japan .
2-110484 4/1990 Japan .
4-199168 7/1992 Japan .

*Primary Examiner*—William Royer
*Assistant Examiner*—William A Noé
*Attorney, Agent, or Firm*—Oblon, Spivak, McClelland, Maier & Neustadt, P.C.

[57] ABSTRACT

A developing device for an electrophotographic apparatus and a developing roller therefor are disclosed. Polarity identical throughout a range between a magnetic conveying pole and a magnetic depositing pole on a sleeve forms a repulsive magnetic field. Therefore, even when the diameter of the sleeve is reduced for the miniaturization of the developing device, a developer can be surely released from the sleeve despite a decrease in the width of a developer releasing portion in the direction of rotation of the sleeve.

14 Claims, 9 Drawing Sheets

Fig. 10

| | (A-100)/10 | (B-100)/10 | P3 PEAK | P4 PORTION RANGE | BELOW 10 G/O | P5 PEAK | P3-P5 | DESIRABLE SOLID BLACK IMAGES | DEVELOPMENT γ VARIATION |
|---|---|---|---|---|---|---|---|---|---|
| | G/° | G/° | G | G | ° | G | G | | |
| COMP.EX. 1 | 28 | 22 | 580 | 40~60 | 40 | 520 | 60 | O | OCCURRED |
| COMP.EX.2 | 20 | 22 | 520 | 65~80 | 43 | 530 | -10 | O | OCCURRED |
| COMP.EX.3 | 22 | 27 | 550 | 40~60 | 41 | 550 | 0 | O | OCCURRED |
| EX.1 | 16 | 15 | 600 | 50~80 | 45 | 500 | 100 | O | NOT OCCURRED |
| EX.2 | 13 | 10 | 560 | 70~80 | 47 | 540 | 20 | O | NOT OCCURRED |
| EX.3 | 12 | 13 | 500 | 50~70 | 48 | 600 | -100 | O | NOT OCCURRED |
| COMP.EX.4 | 28 | 23 | 580 | 85~95 | 41 | 550 | 10 | X | OCCURRED |
| COMP.EX.5 | 23 | 24 | 570 | 50~70 | 39 | 520 | 50 | X | OCCURRED |
| COMP.EX.6 | 24 | 28 | 520 | 30~55 | 40 | 830 | -110 | X | OCCURRED |

DEVELOPING DEVICE FOR AN IMAGE FORMING APPARATUS AND DEVELOPING ROLLER THEREFOR

BACKGROUND OF THE INVENTION

1. Field of the Invention

The present invention relates to a developing device included in a copier, facsimile apparatus, laser printer or similar electrophotographic apparatus. More particularly, the present invention is concerned with a developing device using a developer consisting of toner and magnetic carrier, and a developing roller therefor.

2. Discussion of the Background

It is a common practice with a copier or similar electrophotographic image forming apparatus to electrostatically from a latent image on a photoconductive element, or image carrier, and develop it with a developer stored in a developing device. The developing device includes a developing roller for conveying a developer consisting of toner and magnetic carrier to the photoconductive element and returning, after the deposition of the toner on the element, the carrier and excess toner to a developer storing section included in the casing of the developing device. To allow the developing roller to so operate, it has been customary to form a flux density pattern on the outer periphery of a sleeve forming a part of the developing roller. The flux density pattern is formed by a main pole for development, a plurality of conveying poles, a releasing pole, and a depositing pole.

In the electrophotographic image forming apparatuses art, there is an increasing demand for miniaturization and high-speed operation allowing a great amount of information to be rapidly dealt with in a limited space. To meet this demand, it is necessary to reduce the size of the developing device operable with the toner and carrier mixture and the size of its developing roller as far as possible.

However, the developing roller with the flux density pattern mentioned earlier has the following problem left unsolved. When the diameter of the developing roller is reduced for the miniaturization of the developing device, the actual distance on the sleeve decreases although the angle (width) may remain the same. As a result, a part of the developer on the sleeve is apt to move from the releasing pole to the depositing pole together with the sleeve before it is fully released from the sleeve, lowering image density and therefore image quality. This is particularly true when the outside diameter of the developing roller or sleeve is less than 20 mm. Further, the conventional process speed causes the sleeve to rotate at a higher speed, aggravating the above occurrence.

In light of the above, Japanese Patent Laid-Open Publication No. 9-281794, for example, teaches a developing roller on which all the magnetic poles from the conveying pole to the depositing pole are of the same polarity. In this configuration, a repulsive magnetic field is formed for exerting a magnetic force which releases the developer from the sleeve. With such a developing roller, it is possible to promote the sharp release of the developer from the roller even when the roller has a small diameter. It was experimentally found that when the poles from the conveying pole to the depositing pole were of the same polarity, the above developing roller was satisfactory as to the initial image characteristic. However, the developing characteristic and therefore development γ (gamma) characteristic varied when a number of images were output, depending on the flux density pattern. As a result, a greater amount of toner was deposited on the photoconductive element, bringing about defective images due to the scattering of toner around an image and the offset to a fixing roller.

SUMMARY OF THE INVENTION

It is therefore an object of the present invention to provide a developing device capable of surely releasing a developer even from a sleeve having a small diameter and maintaining development γ stable over a long period of time, and a developing roller therefor.

In accordance with the present invention, a developing roller for feeding a developer consisting of toner and magnetic carrier to a latent image electrostatically formed on an image carrier to thereby develop the latent image includes a magnet member having a plurality of fixed magnetic poles, and a rotatable nonmagnetic sleeve surrounding the magnet member. The fixed magnetic poles are arranged such that a main pole for transferring the developer deposited on the outer periphery of the sleeve to the image carrier, a conveying pole for conveying the developer deposited on the outer periphery and a depositing pole for depositing the developer on the outer periphery are sequentially formed on the outer periphery in this order in the direction of rotation of sleeve. Magnetic poles from the conveying pole to the depositing pole are of the same polarity. If a flux density is 100 G at a first point on the outer periphery of the sleeve near the depositing pole side of the conveying pole, and if the flux density is A at a second point on the outer periphery of the sleeve 10° upstream of the first point with respect to the direction of rotation of the sleeve, then the flux density satisfies the first relation:

$$(A-100)/10 \leqq 16\ (G/°).$$

Also, if the flux density is 100 G at a third point on the outer periphery of the sleeve near the conveying pole side of the depositing pole, and if the flux density is B at a fourth point on the outer periphery of the sleeve 10° downstream of the third point with respect to the direction of rotation of the sleeve, then the flux density B satisfies the relation:

$$(B-100)/10 \leqq 15(G/°).$$

Also, in accordance with the present invention, a developing device for feeding a developer consisting of toner and magnetic carrier to a latent image electrostatically formed on an image carrier to thereby develop the latent image includes a developing roller having a magnet member having a plurality of fixed magnetic poles and a rotatable nonmagnetic sleeve surrounding the magnet member. A casing accommodates the developing roller and includes a developer storing section storing the developer. The fixed magnetic poles are arranged such that a main pole for transferring the developer deposited on the outer periphery of the sleeve to the image carrier, a conveying pole for conveying the developer deposited on the outer periphery and a depositing pole for depositing the developer on the outer periphery are sequentially formed on the outer periphery in this order in the direction of rotation of the sleeve. Magnetic poles from the conveying pole to the depositing pole are of the same polarity. If a flux density is 100 G at a first point on the outer periphery of the sleeve near the depositing pole side of the conveying pole, and if the flux density is A at a second point on the outer periphery of the sleeve 10° upstream of the first point with respect to the direction of rotation of the sleeve, then the flux density satisfies the first relation:

$$(A-100)/10 \leqq 16\ (G/°).$$

Also, if the flux density is 100 G at a third point on the outer periphery of the sleeve near the conveying pole side of the depositing pole, and if the flux density is B at a fourth point on the outer periphery of the sleeve 10° downstream of said third point with respect to the direction of rotation of the sleeve, then the flux density B satisfies the relation:

$$(B-100)/10 \leqq 15\ (G/°).$$

BRIEF DESCRIPTION OF THE DRAWINGS

The above and other objects, features and advantages of the present invention will become apparent from the following detailed description taken with the accompanying drawings in which:

FIG. 10 is a table comparing Examples 1–3 of the illustrative embodiment and Comparative Examples 1–6 as to measured magnetic characteristic parameters, formation of solid black images, and variation of development γ;

DESCRIPTION OF THE PREFERRED EMBODIMENT

Figure 1:
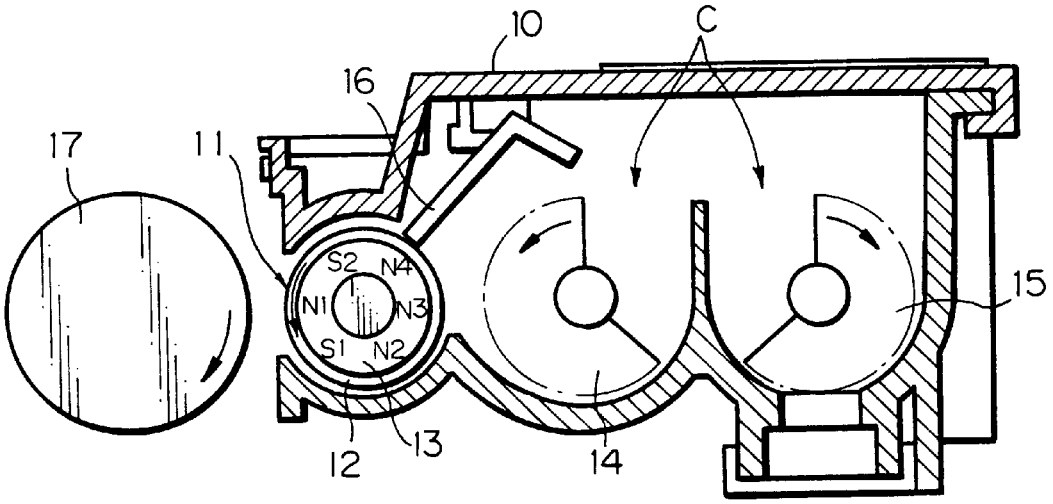
Fig. 1 PRIOR ART
FIG. 1 is a section showing a conventional developing device.

To better understand the present invention, a brief reference will be made to a conventional developing device included in a copier or similar electrophotographic image forming apparatus, shown in FIG. 1. As shown, the developing device includes a developing roller 11 made up of a magnet member 13 and a nonmagnetic rotatable sleeve 12. The magnet member 13 is disposed in the developing roller 11 and provided with a plurality of fixed magnetic poles N1, S1, N2, N3, N4 and S2. The developing roller 11 is accommodated in a casing 10 storing a developer implemented as a toner and magnetic carrier mixture. The developer is magnetically deposited on the sleeve 12 by the magnetic force of the magnet member 13 and conveyed by the sleeve 12 to a main pole P1 (N pole) (see FIG. 2) of the developing roller 11 facing a photoconductive element 17. The photoconductive element 17 is implemented as a drum by way of example. At the main pole P1, the toner contained in the developer is transferred from the sleeve 12 to the drum 17. The carrier left on the sleeve 12 and excess toner are returned to a developer storing section C included in the casing 10. Agitating members 14 and 15 are disposed in the developer storing section C in order to again mix the returned carrier toner with the developer existing in the section C while agitating them.

Figure 2:
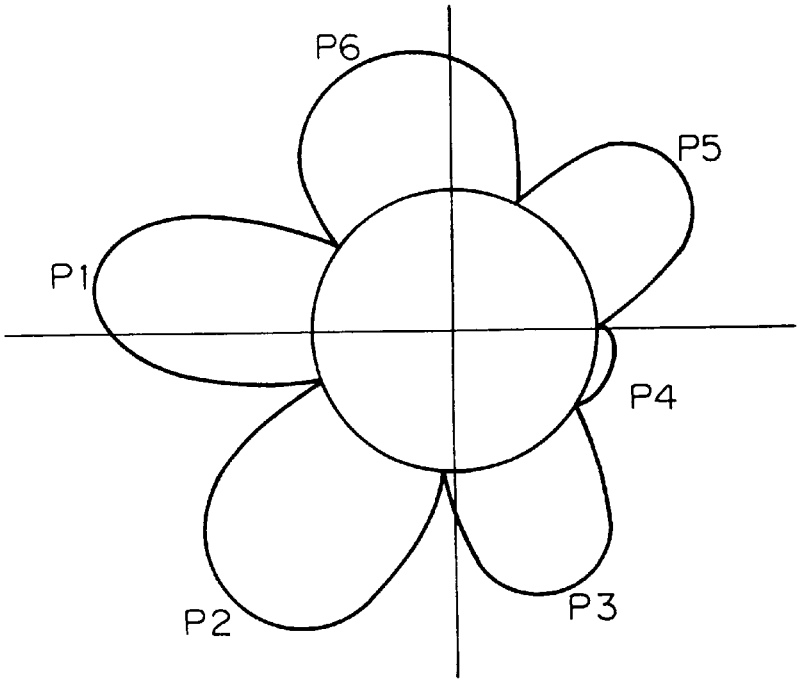
Fig. 2 PRIOR ART
FIG. 2 shows a flux density pattern formed on a developing roller included in the conventional developing device.

FIG. 2 shows a flux density pattern generally formed on the outer periphery of the sleeve 12 for allowing the developing roller 12 to convey the developer to the main pole P1 and then return the carrier and excess toner to the developer storing section C, as stated above. As shown, the flux density pattern consists of a conveying pole P2 (S pole), a conveying pole P3 (N pole), a releasing pole P4 (N pole), a depositing pole P5 (N pole), a conveying pole P6 (S pole), and the main pole P1 (N pole). Among them, the conveying poles P2, P3 and P6 convey the developer present on the sleeve 12 in the direction of rotation of the sleeve 12. The depositing pole P5 draws up the developer existing in the developer storing section C and causes it to deposit on the sleeve 12. The releasing pole P4 intervenes between the poles P3 and P5 and releases the developer from the outer periphery of the sleeve 12.

In the above developing device, the developer in the developer storing section C is magnetically deposited on the sleeve 12 by the depositing pole P5. The developer deposited on the sleeve 12 is conveyed by the conveying pole P6 due to the rotation of the sleeve 12 while being regulated to a preselected amount by a doctor blade 16. On reaching the main pole P1, the toner of the developer is transferred from the sleeve 12 to the drum 17, developing a latent image electrostatically formed on the drum 17. Subsequently, the carrier and excess toner are conveyed by the conveying poles P2 and P3 and then released from the sleeve 12 by the releasing pole P4 whose magnetic force is weak. As a result, the carrier and excess toner are collected in the developer storing section C.

The problem with the developing roller 11 having the flux density pattern shown in FIG. 2 is that when the diameter of the roller 1 is reduced for miniaturization, the actual distance on the sleeve 12 decreases although the angle (width) may remain the same, as discussed earlier. As a result, a part of the developer on the sleeve 12 is apt to move from the releasing pole P4 to the depositing pole P5 before it is fully released from the sleeve 12, lowering image density and therefore image quality.

Figure 3:
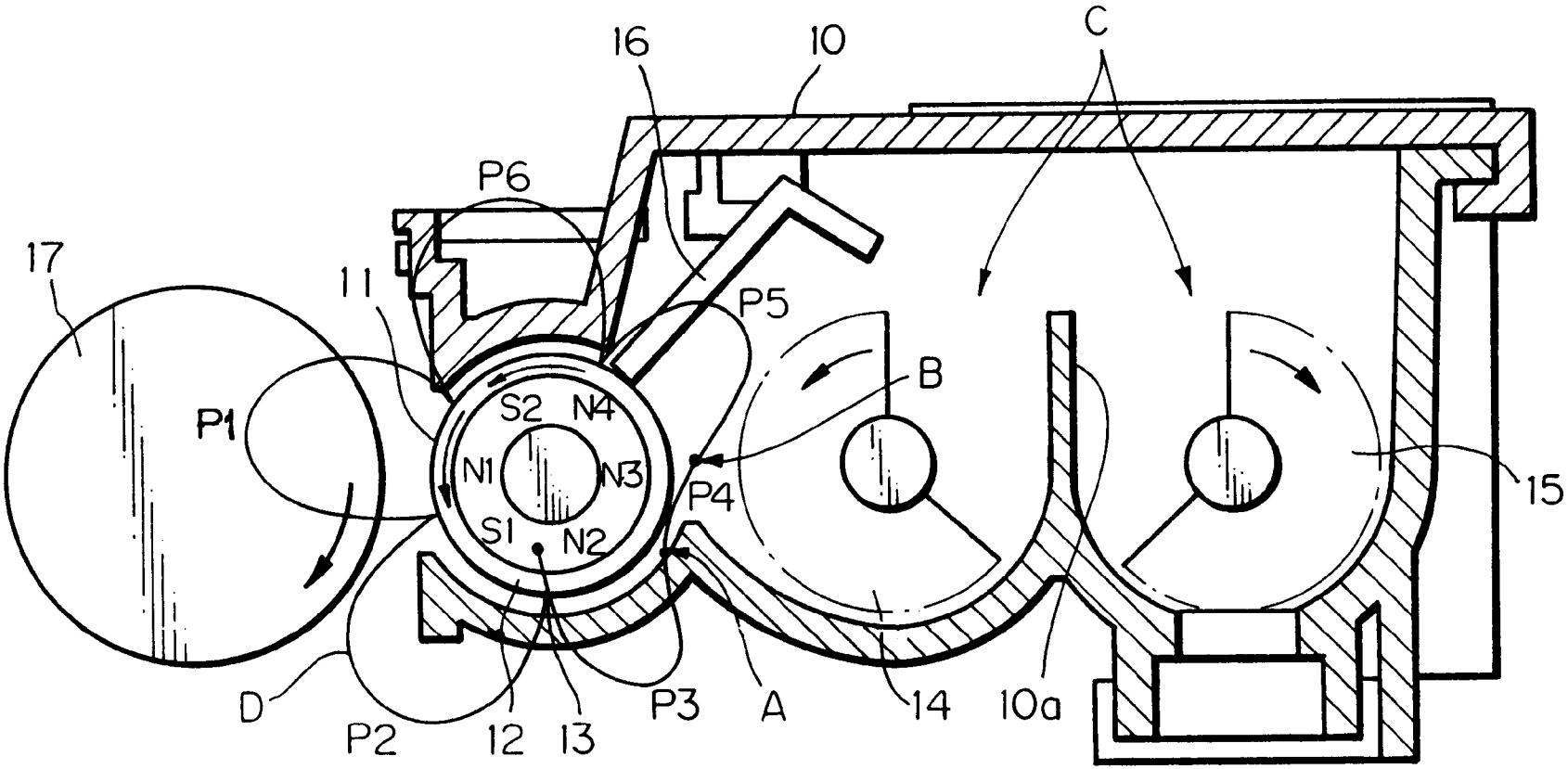
FIG. 3 is a section showing a developing device embodying the present invention.

Referring to FIG. 3, a developing device embodying the present invention will be described. As shown, the developing device includes a developing roller 11 disposed in a casing 10 and having a diameter of 16 mm. The developing roller 11 is rotated in a direction indicated by an arrow in FIG. 3. A first and a second agitating and conveying member 14 and 15, respectively, are positioned in a developer storing section C included in the casing 10, and each is rotatable in a direction indicated by an arrow in FIG. 3. The first agitating and conveying member 14 has a diameter of rotation of 19 mm and is spaced from the developing roller 11 by a preselected gap. The second agitating and conveying member 15 faces the first member 14 with the intermediary of a wall 10*a*. The developing roller 11 is made up of a rotatable sleeve 12 and a stationary magnet member 13 disposed in the sleeve 12 and provided with a number of magnetic poles. A doctor blade or regulating member 16 regulates the amount of a developer being conveyed by the sleeve 12.

For the conveyance of the developer, use is made of a circulation system in which the developer is conveyed by the second agitating and conveying member 15 from the front to the rear in the direction perpendicular to the sheet surface of FIG. 3, transferred from the member 15 to the first agitating and conveying member 14, and then conveyed by the member 14 from the rear to the front in the above direction. A preselected amount of developer (toner and carrier mixed with a preselected ratio) is stored in the casing 10. In the illustrative embodiment, the toner is provided with a volume mean particle size of about 9 μm by pulverization while the carrier is provided with a volume mean particle size of about 50 $\mu$m and coated with resin.

Figure 4:
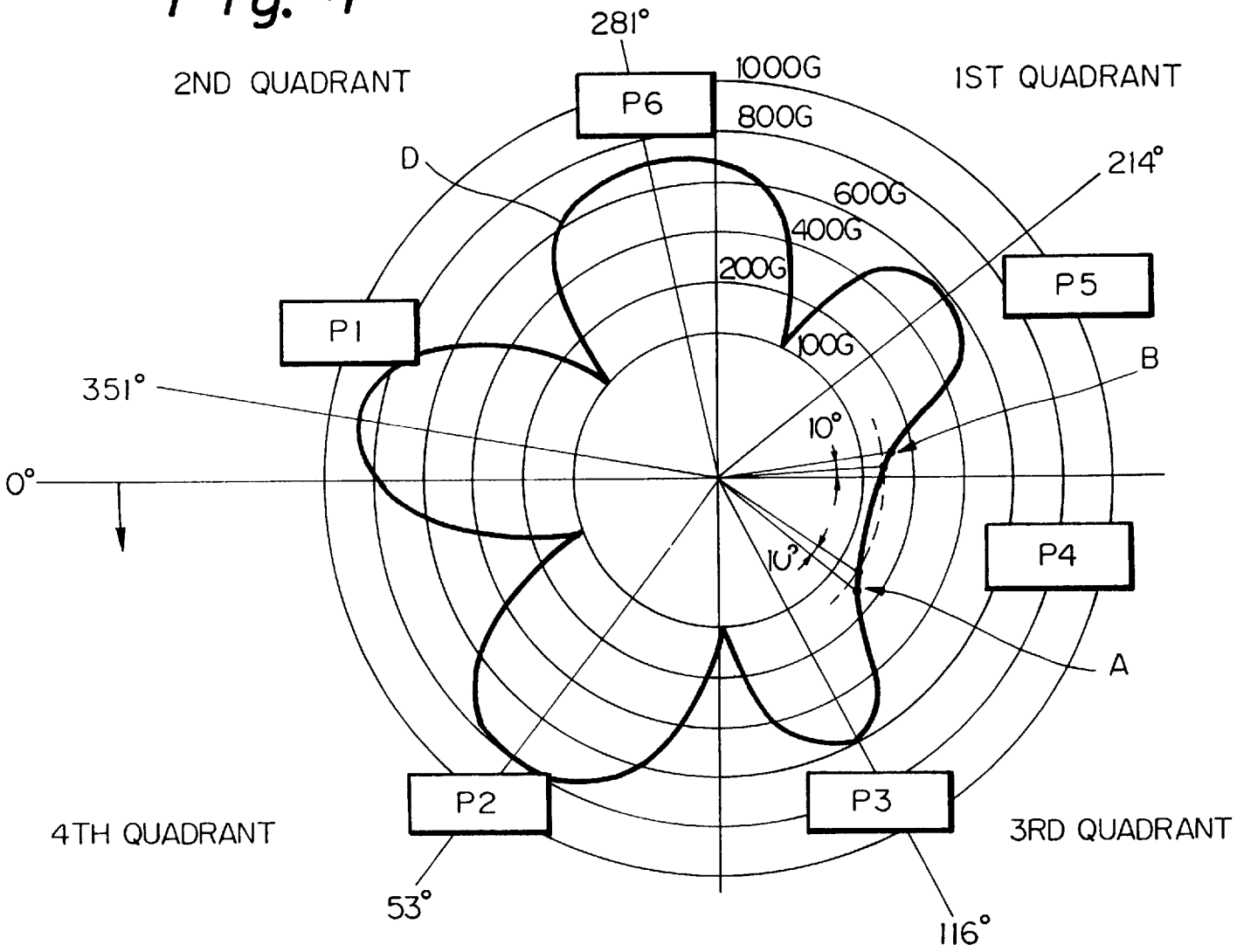
FIG. 4 shows a flux density pattern particular to the illustrative embodiment.

FIG. 4 shows a flux density pattern formed on the outer periphery of the sleeve 11 by the fixed magnetic poles of the magnet member 13. During development, the developer is fed from the first agitating and conveying member 14 to the sleeve 12 and magnetically deposited on the sleeve 12. Then, the developer is conveyed by the sleeve 12, which is in rotation, while being regulated to an adequate amount by the doctor blade 16. When the developer reaches a developing region where the sleeve 12 faces a photoconductive element implemented as a drum 17, the developer develops a latent image electrostatically formed on the drum 17. The developer left on the sleeve 12 after the development is conveyed by conveying poles P2 and P3 and then released from the sleeve 12 by a magnetic pole P4. The developer released from the sleeve 12 is collected in the developer storing section C and again mixed with the developer existing in the section C. Let the portion between the conveying pole P3 and a drawing pole or depositing pole P5 be referred to as a releasing portion for the sake of illustration. The magnetic pole P4 is positioned in the releasing portion.

The magnetic characteristic of the developing roller 11 is as follows. In FIG. 4, a curve D is representative of a flux density distribution on the sleeve 11. In the illustrative embodiment, the flux density pattern on the sleeve 12 between the conveying pole P3 and the drawing pole P5 has a particular configuration for promoting the sharp release of the developer in the releasing portion, as follows.

(1) The range between the conveying pole 3 and the drawing pole P5 downstream of the pole 3 in the direction of rotation of the sleeve 12 is provided with the same polarity (N pole in the illustrative embodiment). If a flux density is 100 G at a first point on the outer periphery of the sleeve near the depositing pole side of the conveying pole, and if the flux density is A at a second point on the outer periphery of the sleeve 10° upstream of the first point with respect to the direction of rotation of the sleeve, then the flux density satisfies the first relation:

$$(A-100)/10 \leqq 16\ (G/°)$$

Also, if the flux density is 100 G at a third point on the outer periphery of the sleeve near the conveying pole side of the depositing pole, and if the flux density is B at a fourth point on the outer periphery of the sleeve 10° downstream of the third point with respect to the direction of rotation of the sleeve, then the flux density B satisfies the relation:

$$(B-100)/10 \leqq 15\ (G/°).$$

The polarity identical throughout the range between the conveying pole P3 and the drawing pole P5 forms a repulsive magnetic field. Therefore, even when the diameter of the sleeve 12 is reduced for miniaturization, the developer can be surely released from the sleeve 12 despite a decrease in the width of the releasing portion in the direction of rotation of the sleeve 12. Moreover, the flux densities A and B each satisfying a particular relation, as stated above, prevent the flux density in the releasing portion from sharply varying. This insures stable development $\gamma$ despite aging.

(2) The releasing portion between the conveying pole P3 and the drawing pole P5 includes a portion having a flux density which is greater than 5% inclusive, but smaller than 15% inclusive, of the peak flux density of the conveying pole P3. Should the flux density of the releasing portion be less than 5% of the peak flux density of the pole P3, the repulsive magnetic field would be weak and would cause the developer to move together with the sleeve 12. Should the flux density of the releasing portion be greater than 15% of the peak flux density of the conveying pole P3, the drawing force of the pole P5 would fail to sufficiently act on the developer of the developer storing section C and would thereby bring about defective draw-up of the developer although the releasing range would be broadened. Should the flux density of the releasing portion be further increased, the developer would move together with the sleeve 12.

(3) In the above portion where the flux density is greater than 5% inclusive, but smaller than 15% inclusive, of the peak flux density of the conveying pole P3, the range in which the variation of the flux density in the direction of rotation of the sleeve 12 is less than 10 (G/°) inclusive extends over more than 40° inclusive in the above direction. When the flux density is almost constant, i.e., when the variation is less than or equal to 10 G/°, the magnetic force is nearly zero and prevents the developer from depositing on the sleeve 12. That is, because the magnetic force acting on the developer is expressed in terms of the variation ratio of the flux density, no magnetic force acts on the developer so long as the flux density is constant. If the variation range of the flux density is less than 40°, the developer once released from the sleeve 12 by the pole P4 would again deposit on the portion of the sleeve 12 corresponding to the drawing P5 without being collected by the conveying member 14.

(4) A difference between the peak flux density of the conveying pole P3 and that of the drawing pole P5 is selected to be less than 100 G. This desirably balances the developer releasing ability and developer drawing ability and improves the agitation of the developer.

Figure 5:
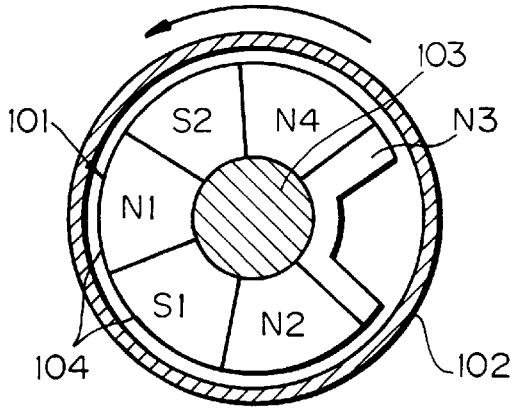
FIGS. 5, 6 and 7 each show a specific configuration of the developing roller of the illustrative embodiment together with an arrangement of fixed magnetic poles.
Figure 6:
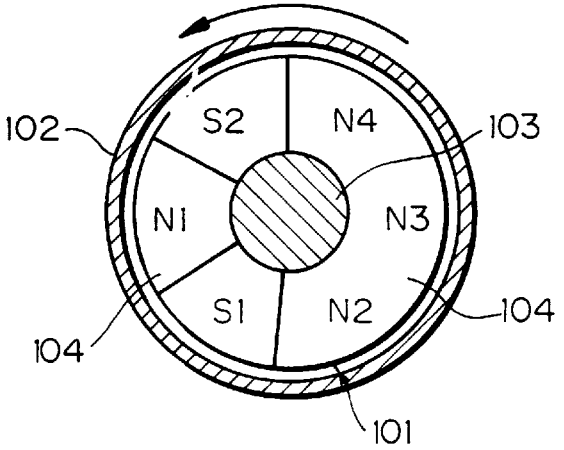
Figure 7:
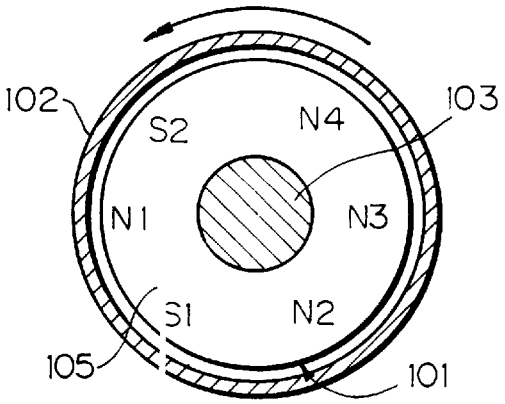

Reference will be made to FIGS. 5–7 for describing specific configurations of the developing roller 11. As shown, the developing roller 11 is made up of a metallic core 103, a magnet member 101 fixed to the core 103, and a rotatable sleeve 102 surrounding the magnet member 101 and formed of aluminum. While the developer forms a magnet brush on the sleeve 12 due to the magnetic force of the magnet member 101, the sleeve 102 in rotation conveys the magnet brush to a developing region where the sleeve 102 faces the drum 17. There are formed on the magnet member 101 a fixed magnetic pole N4 forming the drawing pole P5, a fixed magnetic pole S2 forming the conveying pole P6, a fixed magnetic pole N1 forming the main pole P1, fixed magnetic poles S1 and N2 respectively forming the conveying poles P2 and P3, and a fixed magnetic pole N3 forming the releasing pole P4.

As shown in FIG. 5 or 6, the magnet member 101 is produced by adhering magnet pieces 104 of plastic or rubber to the core 103 and then magnetizing the pieces 104. Alternatively, as shown in FIG. 7, a roll 105 molded integrally with the core 103 may be magnetized.

When the magnet member 101 has the configuration shown in FIG. 5 or 6, the portions forming the fixed pole N2 to the fixed pole N3 should preferably be implemented as a single piece. Assume that the poles N2, N3 and N4 are implemented as independent magnet pieces. Then, the variation of the flux density from the pole P3 to the pole P4 on the sleeve 102 and the variation of the flux density from the pole P4 to the pole P5 are so sharp, the release of the developer is promoted too much. This causes development $\gamma$ to vary due to aging.

In the above configuration, the developer is caused to deposit on the sleeve 102 between the different poles N4, S2, N1, S1 and N2 alternating with each other. On the other hand, the developer is released from the sleeve 102 between the poles N2 and N4 of the same polarity.

In the illustrative embodiment, the developing roller 11 is produced by a sequence of steps of producing a tubular molding (magnet member) by extrusion molding in a magnetic field, demagnetizing the molding, cutting the demagnetized molding at a preselected length, inserting the core 103 into the cut piece of molding, magnetizing the piece with the core 103, and mounting the sleeve 102 and flanges, not shown, to the magnetized piece. Of course, the roller 11 may be implemented as a single molding including a core. Further, to produce the roller 11, individual magnet pieces may be produced by extrusion molding or injection molding and then adhered to a core, in which case the poles N2, N3 and N4 should preferably be formed integrally, as shown in FIG. 6.

Figure 8:
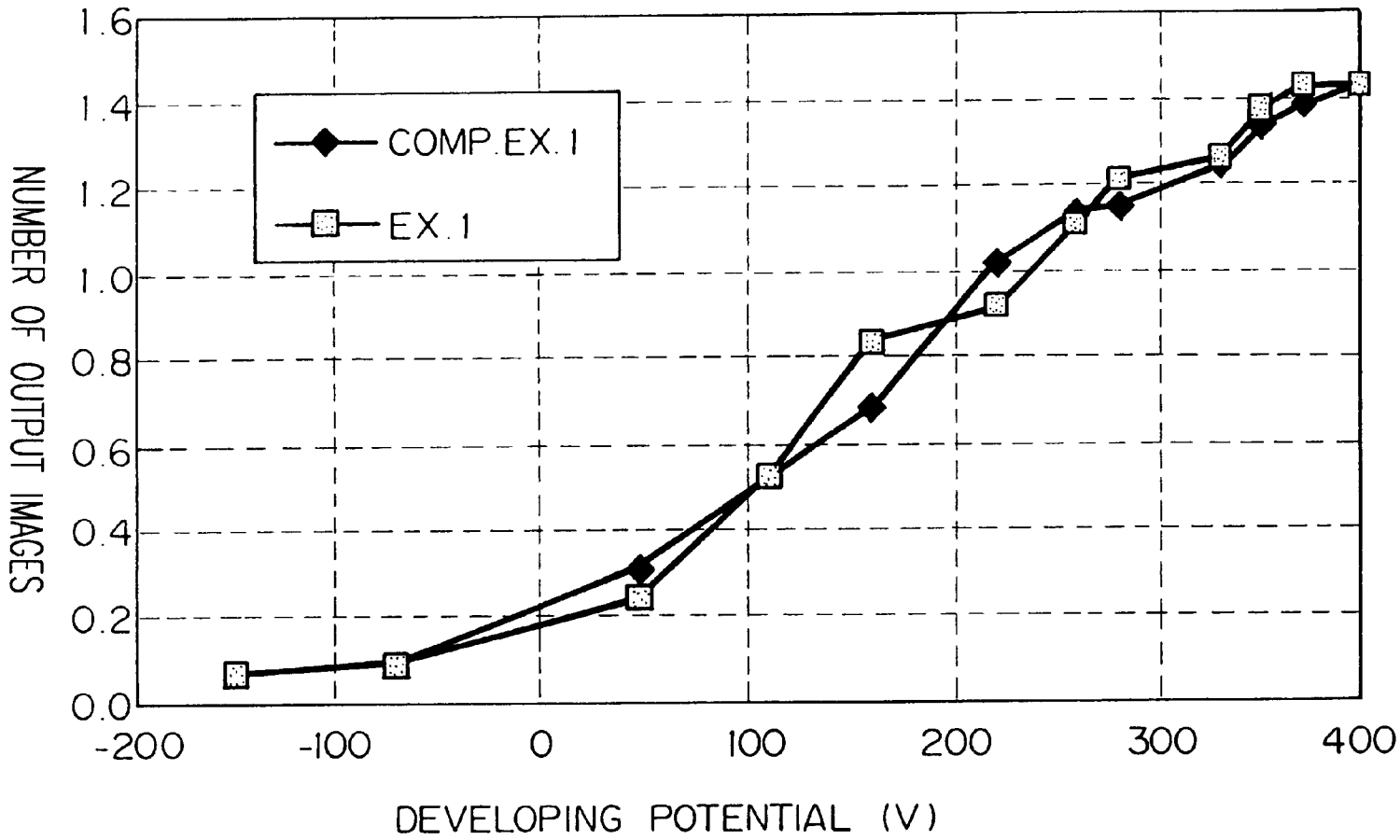
FIG. 8 is a graph showing the variations of development γ determined with Example 1 of the illustrative embodiment and Comparative Example 1 at an initial stage.
Figure 9:
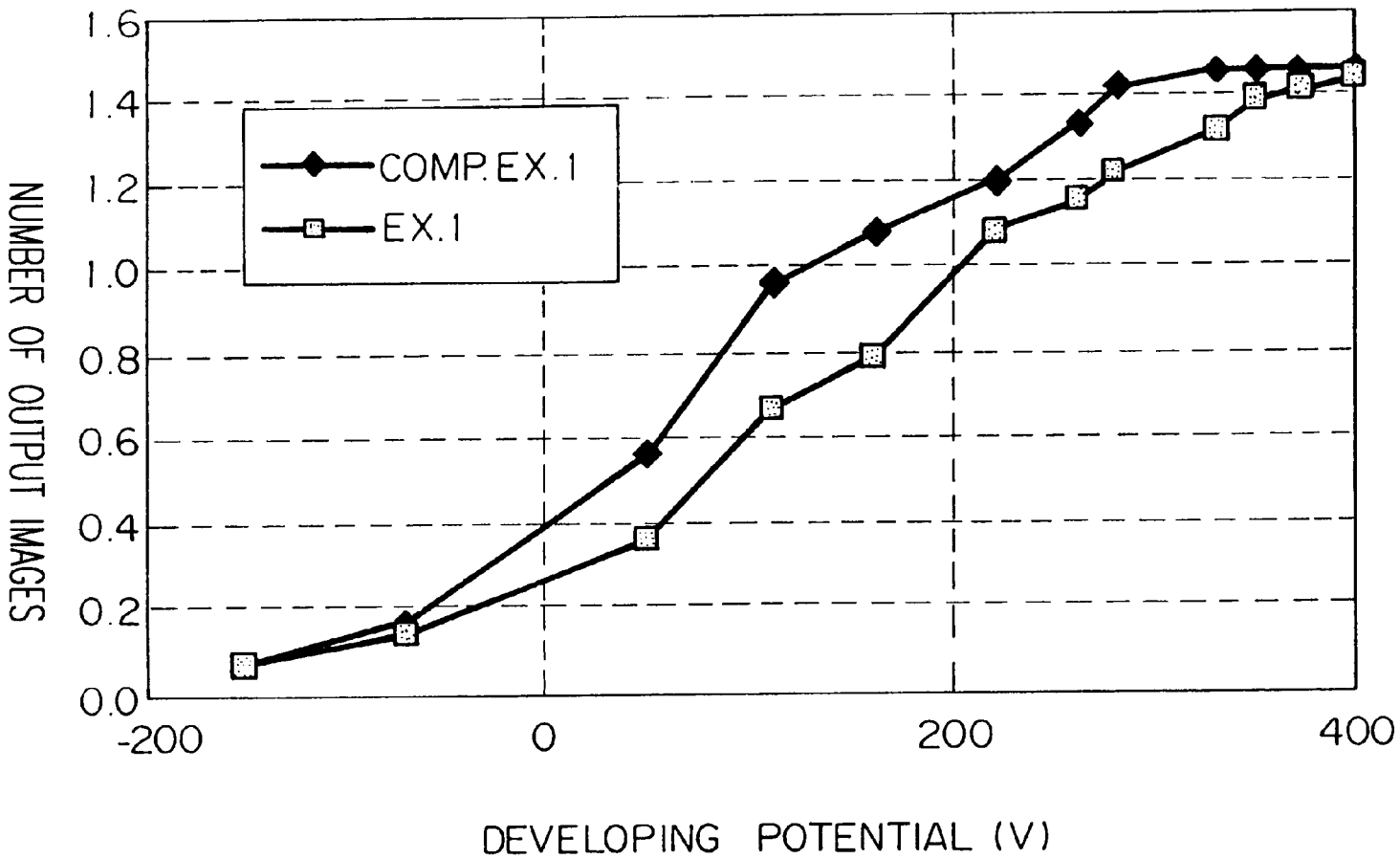
FIG. 9 is a graph similar to FIG. 8, showing variations observed after aging.
Figure 11:
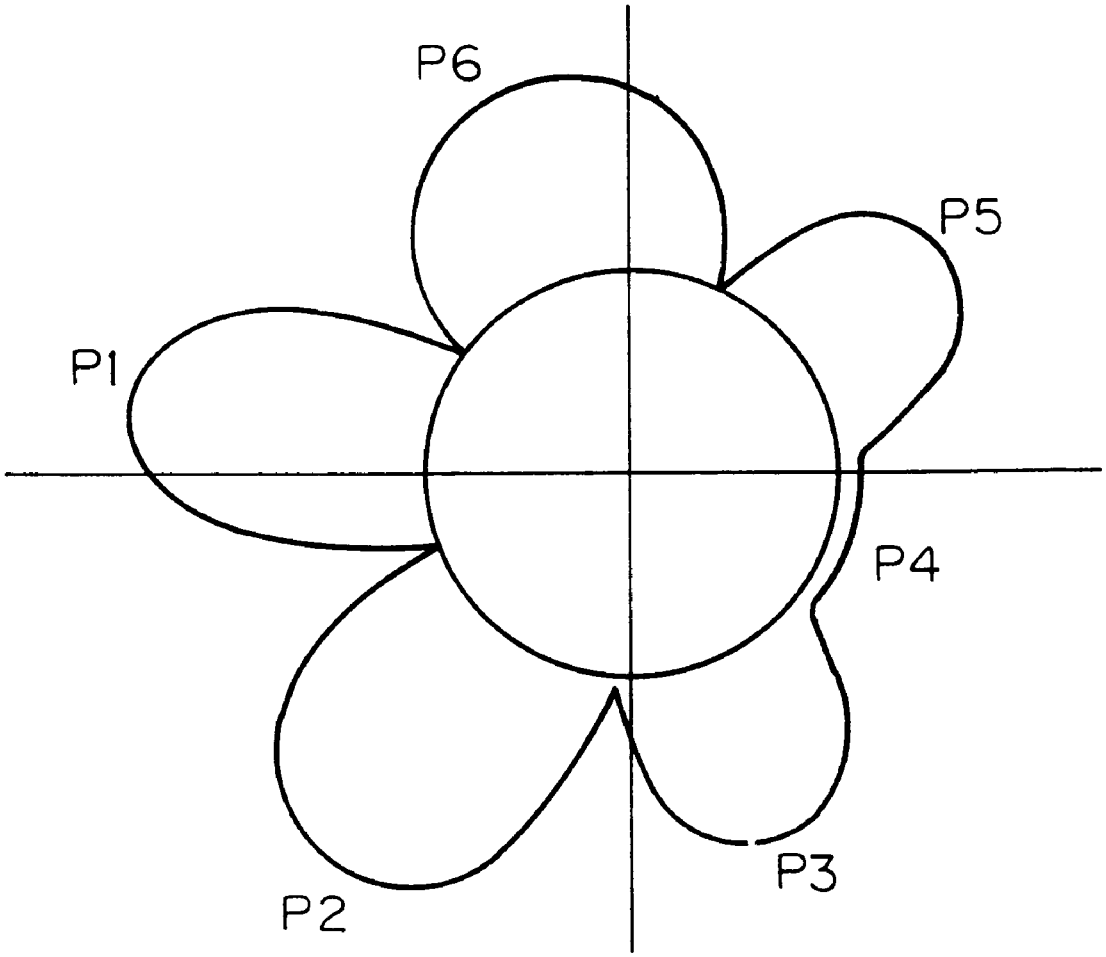
FIG. 11 shows a flux density pattern particular to Comparative Example 1.

The results of experiments conducted with the illustrative embodiment for outputting images will be described hereinafter. FIG. 8 shows how development γ varied at the initial stage, i.e., when the first image was output. FIG. 9 shows the variation of developmenty observed when the 1,500th image was output. In FIGS. 8 and 9, curves with blank squares indicate data particular to a developing roller produced by Example 1 shown in FIG. 10. Curves with solid squares indicate data particular to a developing roller produced by Comparative Example 1 shown in FIG. 10 and having a flux density pattern shown in FIG. 11. As FIGS. 8 and 9 indicate, the initial development γ is the same in both of Example 1 and Comparative Example 1. However, after aging (1,500th image), development γ tends to be higher in Comparative Example 1 than in Example 1. It was found by the experiments that only in Comparative Example 1 was a greater amount of toner deposited on the photoconductive drum after aging, causing the toner to scatter around an image or deposit on a fixing roller.

Figure 12:
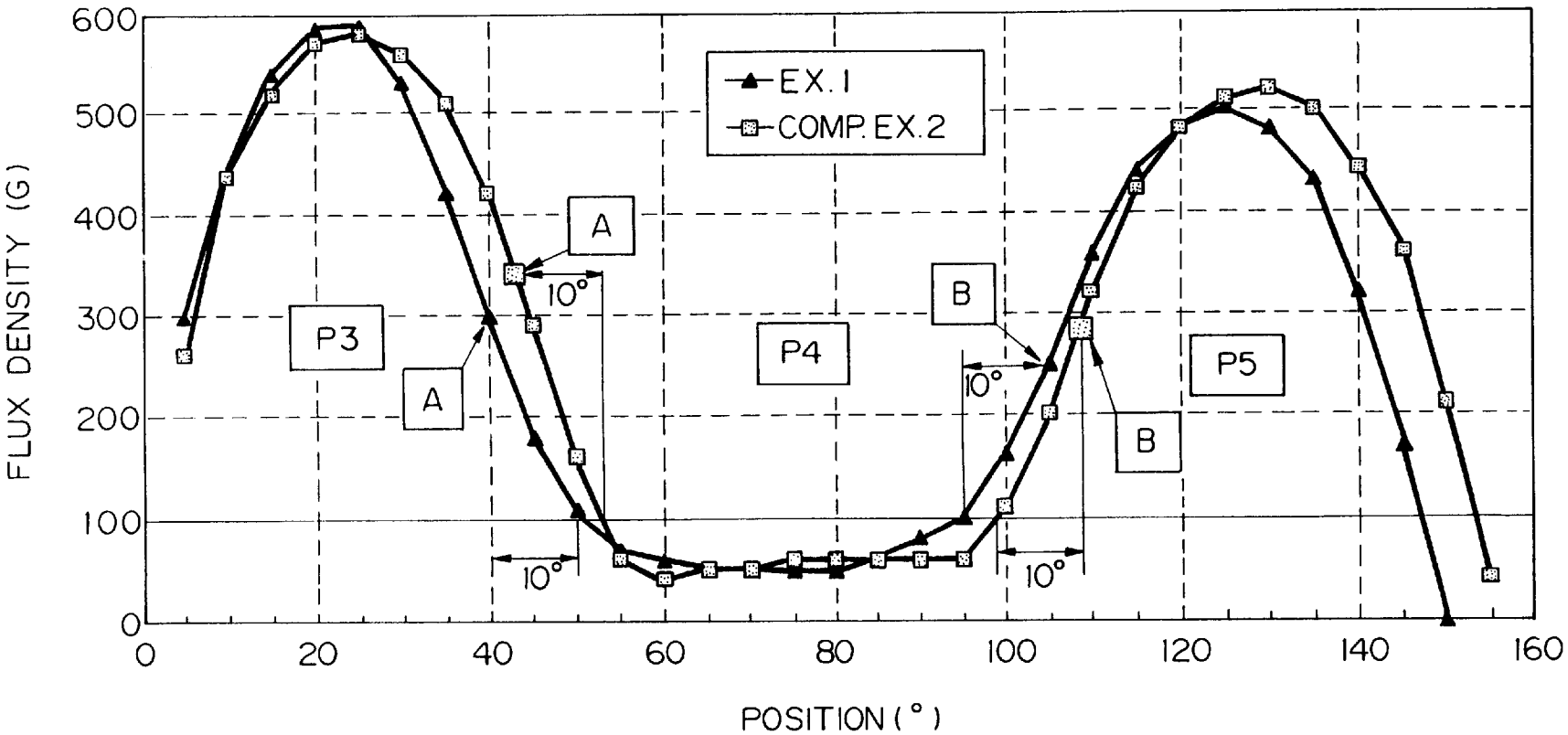
FIG. 12 shows flux density distributions respectively particular to Example 1 and Comparative Example 2 in detail.

FIG. 12 shows a flux density distribution on the sleeve from the conveying pole P3 to the drawing pole P5 in detail. In FIG. 12, a curve with solid triangles shows data particular to the developing roller of Example 1 while a curve with blank squares shows data particular to a developing roller produced by Comparative Example 2 of FIG. 10. The abscissa of FIG. 12 indicates angular positions measured on the basis of ordinates shown in FIG. 4 with a start point at conveying pole P3.

As FIG. 12 indicates, in Comparative Example 2, the flux densities A and B stated earlier are respectively (A−100)/10=20(G/°) and (B−100)/10=22(G/°). By contrast, in Example 1, the flux densities A and B are respectively (A−100)/10=16(G/°) and (B−100)/10=15(G/°). This, coupled with the results of experiments shown in FIGS. 6 and 7, proves that development γ varies little when the variation of the flux density is slow.

FIG. 10 lists magnetic characteristic parameters, formation of solid black images and variation of development γ determined with each of three Examples including Example 1 and six Comparative Examples including Comparative Examples 1 and 2. FIG. 10 also shows that so long as the flux densities A and B satisfy the above respective relations, solid black images are desirably formed while development γ is free from variation (the marks O indicates black images desirably formed and the marks X indicate black images not desirably formed).

It was experimentally found that the above advantages of the illustrative embodiment were surely achievable even when the outside diameter of the sleeve 12 was reduced below 20 mm for the miniature construction of the developing device.

In summary, it will be seen that the present invention provides a developing device and a developing roller therefor having various unprecedented advantages, as enumerated below.

(1) Magnetic polarity identical throughout a range between a conveying pole and a depositing pole on a sleeve forms a repulsive magnetic field. Therefore, even when the diameter of the sleeve is reduced for miniaturization, a developer can be surely released from the sleeve despite a decrease in the width of a releasing portion in the direction of rotation of the sleeve. Moreover, the flux densities A and B stated earlier each satisfying a particular relation prevent the flux density in the releasing portion from sharply varying. This insures stable development γ despite aging.

(2) A region where the flux density lies in a preselected range is included in the portion between the conveying pole and the depositing pole on the sleeve. This prevents the developer from moving together with the sleeve and obviates the defective draw-up of the developer by the depositing pole.

(3) In the portion between the conveying pole and the depositing pole on the sleeve, the variation of flux density in the direction of rotation of the sleeve is selected to be less than 10 (G/°) inclusive, so that a magnetic force attracting the developer onto the sleeve can be reduced to substantially zero. Moreover, because the range in which the above variation of the flux density is less than 10 (G/°) inclusive extends over more than 40° inclusive, the developer released from the sleeve is prevented from again depositing on the sleeve due to the depositing pole and moving together with the sleeve.

(4) A difference between the peak flux density of the conveying pole and that of the depositing pole is selected to be less than 100 G. This desirably balances the developer releasing ability and developer drawing ability and improves the agitation of the developer.

(5) The fixed magnetic poles of the magnet member for forming the conveying pole to the depositing pole on the sleeve are implemented as a single magnet. Therefore, a flux density pattern preventing the flux density from noticeably varying can be easily formed between the conveying pole and the depositing pole.

(6) A regulating member for regulating the amount of the developer deposited on the sleeve is positioned downstream of the depositing pole in the direction of rotation of the sleeve. The regulating member forms a portion where the developer gathers at its upstream side. This, coupled with an intense stress acting on the developer being passed through a small gap between the regulating member and the sleeve, allows the developer on the sleeve to be sufficiently charged before it reaches a developing region where the main pole is positioned.

(7) Assume a section perpendicular to the axis of the developing roller and having the center of the roller as an origin. Then, when the main pole lies in the second quadrant, the depositing portion lies in the first quadrant. In this condition, gravity acting on the developer is effectively used to deposit the developer on the sleeve. Moreover, the releasing portion intervenes between the depositing pole lying in the first quadrant and the conveying pole lying in the fourth quadrant, so that gravity acting on the developer in the releasing portion is effectively used to release the developer from the sleeve.

Various modifications will become possible for those skilled in the art after receiving the teachings of the present disclosure without departing from the scope thereof.

What is claimed is:

1. A developing roller for feeding a developer consisting of toner and magnetic carrier to a latent image electrostatically formed on an image carrier to thereby develop said latent image, said developing roller comprising:

a magnet member having a plurality of fixed magnetic poles; and a rotatable nonmagnetic sleeve surrounding said magnet member;

said plurality of fixed magnetic poles being arranged such that a main pole for transferring the developer deposited on an outer periphery of said sleeve to the image carrier, a conveying pole for conveying said developer deposited on said outer periphery and a depositing pole for depositing said developer on said outer periphery are sequentially formed on said outer periphery in this order in a direction of rotation of said sleeve;

magnetic poles from said conveying pole to said depositing pole being of a same polarity;

wherein if a flux density is 100 G at a first point on the outer periphery of said sleeve near the depositing pole side of the conveying pole, and if the flux density is A at a second point on the outer periphery of said sleeve 10° upstream of said first point with respect to the direction of rotation of said sleeve, then said flux density is selected to satisfy a first relation:

$$(A-100)/10 \leqq 16(G/°)$$

and if the flux density is 100 G at a third point on the outer periphery of said sleeve near the conveying pole side of said depositing pole, and if the flux density is B at a fourth point on the outer periphery of said sleeve 10° downstream of said third point with respect to the direction of rotation of said sleeve, then the flux density B satisfies a relation $$(B-100)/10 \leqq 15(G/°).$$

2. A developing roller as claimed in claim 1, wherein there exists a region between said conveying pole and said depositing pole, in which the flux density is greater than a lower limit so that the developer on said sleeve is repelled from said sleeve, and less than an upper limit so that the depositing pole can attract a sufficient amount of developer to said sleeve.

3. A developing roller as claimed in claim 2, wherein said lower limit and said upper limit are 5% and 15% of a peak flux density of said conveying pole, respectively.

4. A developing roller as claimed in claim 1, wherein an angular range in which a variation of the flux density in the direction of rotation of said sleeve is less than or equal to 10 (G/°) extends over at least 40° in the direction of rotation of the sleeve.

5. A developing roller as claimed in claim 1, wherein a difference between a peak flux density of said conveying pole and a peak flux density of said depositing pole is less than 100 G.

6. A developing roller as claimed in claim 1, wherein said fixed magnetic poles for forming said conveying pole and said depositing pole are implemented as a single magnet.

7. A developing device for feeding a developer consisting of toner and magnetic carrier to a latent image electrostatically formed on an image carrier to thereby develop said latent image, said developing device comprising:

a developing roller comprising a magnet member having a plurality of fixed magnetic poles and a rotatable nonmagnetic sleeve surrounding said magnet member; and a casing accommodating said developing roller and including a developer storing section storing the developer;

said plurality of fixed magnetic poles being arranged such that a main pole for transferring the developer deposited on an outer periphery of said sleeve to the image carrier, a conveying pole for conveying said developer deposited on said outer periphery and a depositing pole for depositing said developer on said outer periphery are sequentially formed on said outer periphery in this order in a direction of rotation of said sleeve;

magnetic poles from said conveying pole to said depositing pole being of a same polarity;

wherein if a flux density is 100 G at a first point on the outer periphery of said sleeve near the depositing pole side of the conveying pole, and if the flux density is A at a second point on the outer periphery of said sleeve 10° upstream of said first point with respect to the direction of rotation of said sleeve, then said flux density satisfies a first relation:

$$(A-100)/10 \leqq 16(G°)$$

and if the flux density is 100 G at a third point on the outer periphery of said sleeve near the conveying pole side of said depositing pole, and if the flux density is B at a fourth point on the outer periphery of said sleeve 10° downstream of said third point with respect to the direction of rotation of said sleeve, then the flux density B satisfies a relation $$(B-100)/10 \leqq 15(G/°).$$

8. A developing device as claimed in claim 7, further comprising a regulating member between said depositing pole and said main pole, the regulating member being spaced from the outer periphery of said sleeve by a preselected gap.

9. A developing device as claimed in claim 7, wherein in a section perpendicular to an axis of said developing roller and having a center of said developing roller as an origin, said magnet member is divided into first, second, third and fourth quadrants such that when said main pole lies in the second quadrant, said depositing portion and said conveying pole lie in the first quadrant and the fourth quadrant, respectively.

10. A developing device as claimed in claim 7, wherein there exists a region between said conveying pole and said depositing pole, in which the flux density is greater than a lower limit so that the developer on said sleeve is repelled from said sleeve, and less than an upper limit so that the depositing pole can attract a sufficient amount of developer to said sleeve.

11. A developing device as claimed in claim 10, wherein said lower limit and said upper limit are 5% and 15% of a peak flux density of said conveying pole, respectively.

12. A developing roller as claimed in claim 7, wherein an angular range in which a variation of the flux density in the direction of rotation of said sleeve is less than or equal to 10 (G/°) extends over at least 40° in the direction of rotation of the sleeve.

13. A developing roller as claimed in claim 7, wherein a difference between a peak flux density of said conveying pole and a peak flux density of said depositing pole is less than 100 G.

14. A developing device as claimed in claim 7, wherein said fixed magnetic poles for forming said conveying pole and said depositing pole are implemented as a single magnet.

* * * * *